US005181444A

United States Patent [19]

Bassett

[11] Patent Number: 5,181,444

[45] Date of Patent: Jan. 26, 1993

[54] MULTIPLE BARB PICK

[75] Inventor: John D. Bassett, Kalamazoo, Mich.

[73] Assignee: International Paper Company, Purchase, N.Y.

[21] Appl. No.: 763,721

[22] Filed: Sep. 23, 1991

[51] Int. Cl.[5] ..... B26D 7/18

[52] U.S. Cl. ..... 83/154; 83/107; 83/156; 493/373

[58] Field of Search ..... 83/151, 154, 107, 156; 493/342, 373, 472

[56] References Cited

U.S. PATENT DOCUMENTS

| | | | |
|---|---|---|---|
| 2,677,994 | 5/1954 | Schneider | 493/373 |
| 3,186,274 | 6/1965 | Winkler | 83/152 |
| 3,215,049 | 11/1965 | Meylan et al. | 493/373 |
| 3,348,456 | 10/1967 | Marconet et al. | 493/373 |
| 3,391,589 | 7/1968 | Bishop . | |
| 3,503,309 | 3/1970 | Jones | 493/373 |
| 3,513,756 | 5/1970 | Schutz . | |
| 3,877,353 | 4/1975 | Smith et al. | 493/373 |
| 4,295,842 | 10/1981 | Bell | 493/342 |

*Primary Examiner*—Hien H. Phan
*Attorney, Agent, or Firm*—Michael J. Doyle; Walt Thomas Zielinski

[57] ABSTRACT

A multi-barb pick for a waste stripping machine. The pick is formed from a flat sheet metal piece. Two spaced triangular projections, generally parallel, extend from one section of the piece, with each projection terminating in a barb. Each barb is generally rectangular in form and two adjacent edges thereof are sharpened along each surface thereof. The barb is employed in a conventional waste stripping apparatus for removing cut sections from a paperboard web of indefinite length.

6 Claims, 1 Drawing Sheet

MULTIPLE BARB PICK

BACKGROUND OF THE INVENTION

This invention relates to the art of manufacturing containers from paperboard webs, and more particularly to a device for removing waste pieces from paperboard sheet material defining a web of indefinite length. Each removed waste piece often defines an opening in a container formed by the folding of blanks cut from the web. Typically, one or more cutter elements are mounted on the periphery of one of a first pair of rotating rolls, with the paperboard web passing through the nip of the rolls. The cutter element or elements on one of the rolls of this first pair partially cuts plugs from the web, and downstream of this cutting operation, pins or barbs mounted on one roll of a second pair of rolls engage and pierce the plugs to remove them from the web. After such plug removal, the web may be subsequently cut, provided with score lines and the like for the formation of containers.

The art is aware of apparatus for carrying out similar functions as may be seen for example in U.S. Pat. Nos. 2,677,994 issued to Schneider; 3,503,309 issued to Jones; 3,877,353 issued to Smith et al; and 4,295,842 issued to Bell.

While the pick or barb elements known in the prior art have performed more or less satisfactory, their reliability (always removing a plug) and particularly their tendency to break is less than desirable.

SUMMARY OF THE INVENTION

According to the practice of this invention, a novel multi-barb pick is fashioned from a piece of sheet metal or other hard, rigid material. The pick includes two spaced barbs, with each barb extending from respective triangular projections of the sheet metal piece. Each barb is of generally rectangular form and is beveled on two adjacent edges, on both sides of the sheet metal piece. The barbs extend in the same general direction from their respective triangular projections of the sheet metal piece. The sheet metal piece includes any conventional means for permitting its fastening to a pin or barb cylinder (roll) for use in engaging portions of a paperboard web to remove partially cut-out portions (waste material) from the web.

DETAILED DESCRIPTION OF THE INVENTION

Figure 1:
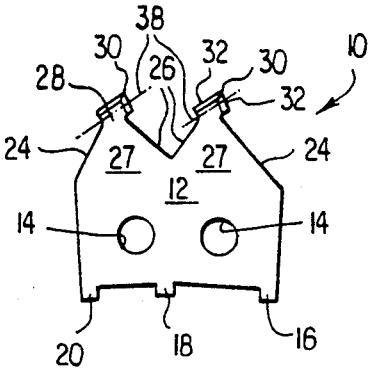
FIG. 1 is a plan view illustrating the multiple barb waste pick of this invention.

Referring now to FIG. 1 of the drawings, the numeral 10 denotes the multi-barb pick of this invention and is fashioned from a piece 12 of sheet metal or other hard, rigid material. Two holes 14 are provided in the lower portion of the piece, with protuberances 16, 18 and 20 being spaced along the lower edges thereof. Openings 14 and the protuberances are employed as means to fasten the pick to a rotatable roll or cylinder, as indicated schematically at FIG. 3, with openings 14 adapted to receive bolts. It will be understood that openings 14 and the protuberances 16, 18, and 20 may be considered as conventional, as illustrating one method for holding or mounting the pick(s) to a rotatable roll cylinder, and do not form any part of this invention. Straight, slanting sides 24 and 26 define two sides of respective generally triangular portions 27, with the bottom of each triangular portion 27 being integral with the main body of sheet metal piece 12. The base or lower portion of the pick is generally rectangular, having a bottom edge along which the protuberances are located, and having generally upwardly extending opposite, lateral sides or edges. The top edge of the generally rectangular lower portion may be considered as an imaginary line extending between the intersection of slanting sides 24 and the tops of upwardly extending lateral sides of the generally rectangular lower portion. The protuberances 16, 18, and 20, and openings 14 are located on the base of the pick. The upwardly pointing tips of triangles 27 terminate, respectively, at laterally spaced, generally rectangular integral barbs 28 each of substantially identical form. Each barb has an uppermost corner 30 between intersecting, free outermost edges 32. Both surfaces of sheet metal piece 12 are beveled at 32 so as to provide sharpening for the barbs. The longitudinal, mid axis of each generally rectangular barb 28 is indicated as 38 and it will be observed that the orientation of each barb 28 is substantially the same, with axes 38 being substantially parallel. Each axis 38 makes an acute angle with respect to an imaginary horizontal line passing through piece 12. The lower left side or edge of each generally rectangular barb 28 may be considered (for purpose of reference) its first side, the lower right side as its second side, the upper right side as its third side, and the upper left side as its fourth side. Thus, beveled edges 32 are located at the third and fourth sides. The left hand side of each triangular portion 27 is seen to meet the first side or edge of its respective barb 28 at a first obtuse angle. The right hand side of each triangular portion 27 is seen to meet the second side or edge of its respective barb 28 at a second angle, with the second angle being less than the first obtuse angle. This results in a portion of the second side of each barb projecting beyond its intersection with the right side of a respective triangular portion. The third and fourth sides of each barb are beveled and meet at uppermost corner 30 of each barb.

Figure 2:
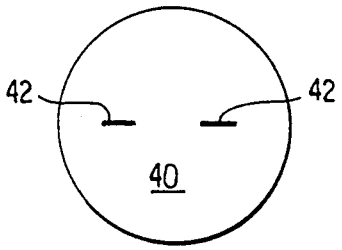
FIG. 2 is a plan view illustrating a typical waste piece, circular in form, which has been engaged and removed by the pick of FIG. 1.
Figure 3:
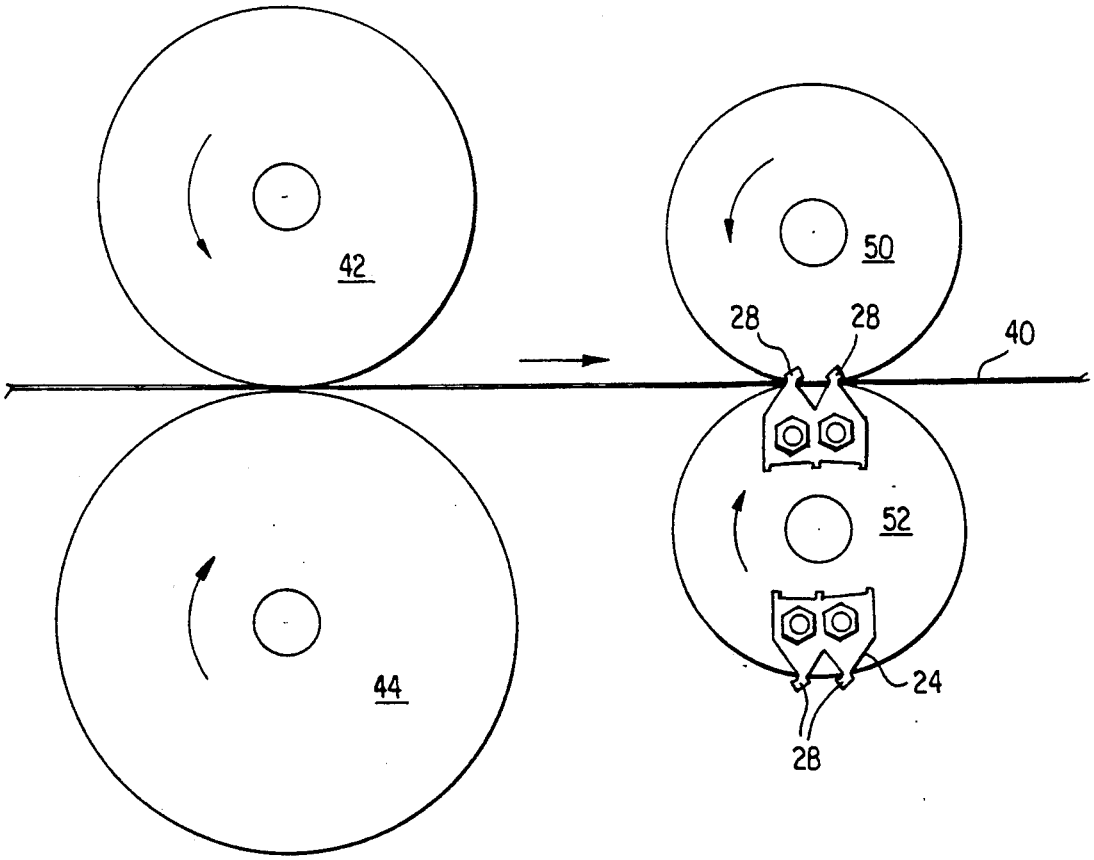
FIG. 3 is a partially schematic view illustrating a paperboard web being pulled through rollers, one of which is provided with the waste pick of this invention.

FIG. 2 illustrates a typical cut-out portion (waste piece) pulled out from a paperboard web 40 of indefinite length by the barbs 28. Barbs 28 have pierced the paperboard web within a circular partially cut area and have gone through the paperboard, as indicated by slits 42, and have removed this waste piece from the travelling web. Web 40 may include thin polyethylene coatings on both sides as in the case of making liquid containers. A somewhat schematic representation of this action of waste removal is shown at FIG. 3 wherein the nip of a pair of rolls 42, 44 receives a moving paperboard web 40 of indefinite length. Typically, one of rollers 42 or 44 will carry one or more cutters to cut partially through the paperboard, so as to produce a circular cut shown at FIG. 2, while downstream positioned rollers 50 and 52 function to remove the waste from the web. Barbs 28 extend into a continuous groove in upper roll 50, the groove permitting passage of the barbs through the paperboard web 40, as is conventional. Roll 52 is shown as provided with a pair of oppositely mounted sheet metal pieces 12 of this invention, typically mounted by bolts or any other conventional means, with barbs 28 piercing a waste piece in web 40. With continued rotation of the rollers, the waste piece impaled on the barbs 28 is pulled off of the barbs by conventional means. It will be understood that the exact mode of mounting the multi-barb pick 10 of this invention on a roll cylinder such as 52, and the number of such picks mounted there is optional and forms no part of this invention.

It will be noted that barbs 28 need not be formed on upwardly extending tips of triangular portions 27 of piece 12, although this is the preferred form of the invention. Instead, the valley formed by intersecting, slanting sides 26 may be omitted, thus omitting the triangular portions 27, with barbs 28 extending sufficiently above piece 12 to permit them to pass completely through web 40 as shown at FIG. 3. Thus the exact shape or contour of piece 12 may be varied within the scope of the invention.

I claim:

1. An integral multi-barb pick for removing waste material form a moving paperboard web, the pick formed of a substantially flat sheet metal piece and including a generally rectangular base, said base having two opposite, upwardly extending lateral edges, two generally triangular portions extending upwardly from said base, the apex of each triangular portion having a generally rectangular barb, each triangular portion having a right side and a left side, the left side of each triangular portion meeting a first side of the respective rectangular barb at a first obtuse angle, the right side of each triangular portion meeting a second side of the respective rectangular barb at a second angle, said second angle being less than said first obtuse angle, a portion of the second side of each barb extending beyond its intersection with the respective right side of the respective triangular portion to define a projection, third and fourth sides of each rectangular barb being beveled and meeting at an uppermost corner of each respective rectangular barb, the bas provided with means to fasten the pick to a rotatable pick roll.

2. The pick of claim 1 wherein the longitudinal axis of each of said generally rectangular barbs is tilted to the horizontal, said horizontal being substantially perpendicular to the lateral edges.

3. The pick of claim 1 mounted on a rotatable pick roll such that said rectangular barbs project radially outwardly from the periphery of said pick roll.

4. An integral multi-barb pick for removing waste material from a moving paperboard web, the pick formed of a substantially flat sheet metal piece and including a base, two generally triangular portions extending upwardly from said base, the apex of each triangular extending portion having a generally rectangular barb, each triangular portion having a right side and a left side, the left side of each triangular portion meeting first side of the respective rectangular barb at a first obtuse angle, a right side of each triangular portion meeting the second side of the respective rectangular barb at a second angle, said second angle being less than said first obtuse angle, a portion of the second side of each rectangular barb extending beyond its intersection with the respective right side of the respective triangular portion to define a projection, third and fourth sides of each rectangular barb being beveled and meeting at an uppermost corner of each respective rectangular barb the base provided with means to fasten the pick to a rotatable pick roll.

5. The pick of claim 4 wherein said base has two upwardly extending lateral edges and wherein the longitudinal axis of each of said generally rectangular barbs is tilted to the horizontal, said horizontal being substantially perpendicular to the lateral edges.

6. The pick of claim 1 mounted on a rotatable pick roll such that said rectangular barbs project radially outwardly from the periphery of said pick roll.

* * * * *